US010359739B2

(12) United States Patent
Vuille

(10) Patent No.: US 10,359,739 B2
(45) Date of Patent: Jul. 23, 2019

(54) FIXING DEVICE

(71) Applicant: The Swatch Group Research and Development Ltd, Marin (CH)

(72) Inventor: Pierry Vuille, Les Emibois (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/819,965

(22) Filed: Nov. 21, 2017

(65) Prior Publication Data

US 2018/0157216 A1 Jun. 7, 2018

(30) Foreign Application Priority Data

Dec. 6, 2016 (EP) ..... 16202428

(51) Int. Cl.
*G04B 37/14* (2006.01)
*A44C 5/14* (2006.01)
*A44C 5/02* (2006.01)

(52) U.S. Cl.
CPC ..... *G04B 37/1486* (2013.01); *A44C 5/02* (2013.01); *A44C 5/14* (2013.01); *G04B 37/1493* (2013.01)

(58) Field of Classification Search
CPC .. G04B 37/1486; G04B 37/1493; A44C 5/02; A44C 5/14
USPC ..... 368/282, 281; 24/265 B, 265 WS; 224/164, 177
See application file for complete search history.

(56) References Cited

U.S. PATENT DOCUMENTS

| | | | | |
|---|---|---|---|---|
| 6,014,793 | A * | 1/2000 | Howald | A44C 5/147 24/115 G |
| 7,380,979 | B2 * | 6/2008 | Hiranuma | A44C 5/14 224/180 |
| 7,946,103 | B2 * | 5/2011 | So | A44C 5/102 24/265 B |
| 9,314,071 | B2 * | 4/2016 | Rivera | A44C 5/14 |
| 9,599,964 | B2 * | 3/2017 | Gracia | G04B 37/0008 |
| 2006/0207067 | A1 | 9/2006 | Maillard | |

FOREIGN PATENT DOCUMENTS

| | | |
|---|---|---|
| EP | 0 494 584 A1 | 7/1992 |
| EP | 1 201 148 A1 | 5/2002 |
| FR | 2 849 355 A1 | 7/2004 |
| WO | WO 2005/018368 A1 | 3/2005 |

OTHER PUBLICATIONS

European Search Report dated Apr. 28, 2017 in European Application 16202428.5, filed on Dec. 6, 2016.

* cited by examiner

*Primary Examiner* — Edwin A. Leon
(74) *Attorney, Agent, or Firm* — Oblon, McClelland, Maier & Neustadt, L.L.P.

(57) ABSTRACT

A fixing device is for attaching a band to a watch case by a connecting link. The watch case includes a case middle, at least one pair of lugs, and a case back. The connecting link includes a passage accepting fixing structure of attachment to the watch case. The fixing structure is incorporated into the connecting link and includes an elastic return separating two pivots mounted with the ability to move inside the passage, and each capable of moving between a compressed position and a rest position in which the pivots are designed to rest in a hole formed in each lug of the watch case.

11 Claims, 3 Drawing Sheets

Fig. 3
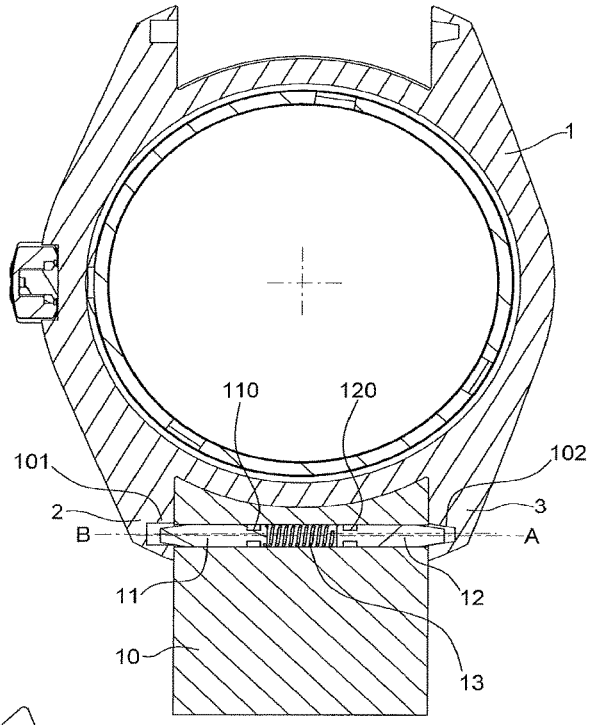
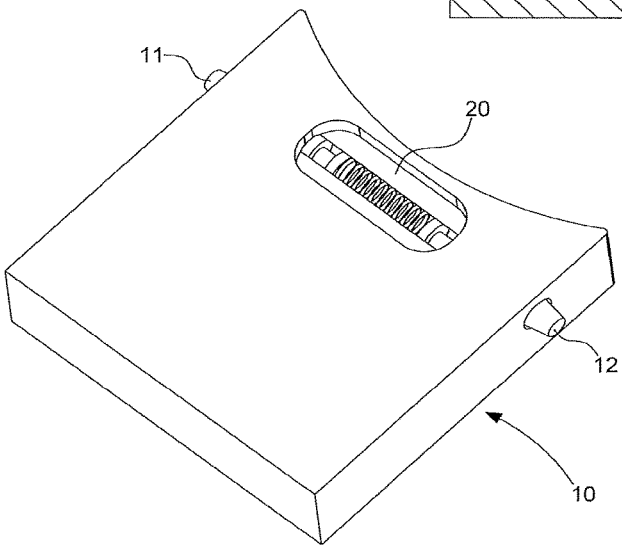
Fig. 4

FIXING DEVICE

This application claims priority from European Patent Application No. 16202428.5 filed on Dec. 6, 2016; the entire disclosure of which is incorporated herein by reference.

FIELD OF THE INVENTION

The present invention relates to a device for connecting a band to a watch case comprising exterior elements made of a hard material such as metal. More specifically, the present invention relates to a connecting link equipped with a bar, both designed to connect a band to a case of a watch.

BACKGROUND OF THE INVENTION

Watches held on the user's wrist by means of a watch band are known from the prior art. This band may be made of leather, of fabric, of rubber, of plastic, of ceramic or even of metal and is connected to the pairs of lugs of the watch case via bars fixed for example between the lugs.

Such an embodiment exhibits a number of disadvantages. Specifically, the traditional bar comprises several small sliding components that form the ends and a cylinder with a spring in the middle to form the body and holding everything together, which means that the bar by design is not rigid and exhibits play so as to allow the components to slide relative to one another (ends pushed back into the cylindrical body).

In addition, the connecting link situated between the case and the other links of the band needs to have lateral gaps so that the band can be fitted and/or removed, thus further detracting from the retention quality of the bar.

In the end analysis, such a setup involves a visible clearance between the watch case in the region between the lugs, and the connecting link of the band, and this is unattractive and gives the impression of a poor fit or of poor-quality manufacturing.

SUMMARY OF THE INVENTION

It is a notable objective of the invention to alleviate the various disadvantages of these known techniques.

More specifically, it is an objective of the invention to eliminate the clearance visible at the interface between the connecting link and the case.

Another objective of the invention is to provide an assembly (case-bar-connecting link) that makes it possible to have looser machining tolerances on the various parts of which it is made, and simplifying assembly (according to the invention, there is no need to have accurate initial positioning between the bar of the connecting link and the case). It is also easier, in order to guarantee perfect coaxially as in current standard scenarios, to reduce the clearance by eliminating the combining of moving parts, and to limit the number of parts in the makeup of the bar.

These objectives, together with others which will become more clearly apparent hereinafter, are achieved according to the invention using a fixing device for attaching a band to a watch case by means of a connecting link, the watch case comprising a case middle, at least one pair of lugs and a case back, the connecting link comprising a passage accepting fixing means of attachment to the watch case.

According to the invention, the fixing means are incorporated into the connecting link and comprise elastic return means comprising a casing equipped with elastic arms in the link, the elastic arms separating two pivots mounted with the ability to move inside the passage, along the longitudinal axis of the passage, and each capable of moving between a compressed position and a rest position in which the pivots are designed to rest in a hole formed in each lug of the watch case.

According to other advantageous alternative forms of the invention:

- the holes in the lugs form a first axis, and the passage forms a second axis, the first axis and the second axis not necessarily being coaxial;
- the pivots comprise a cylindrical body and a truncated cone shape head, the said head being designed to collaborate with a hole in one of the lugs of the watch case;
- the holes are of cylindrical or truncated cone shape;
- the pivots comprise a cylindrical body and a head of cylindrical or truncated cone shape designed to collaborate with the holes;
- the casing has a gap that makes it easier for the elastic arms to deform and limit stops for limiting the travel of the elastic arms;
- the passage takes the form of a right cylinder;
- the connecting link is made of plastic, of ceramic, of composite or of metal.

The invention also and in particular relates to any timepiece comprising at least one connecting link and its bar according to the invention.

BRIEF DESCRIPTION OF THE DRAWINGS

Other features and advantages of the invention will become more clearly apparent from reading the following description of one particular embodiment of the invention, given by way of simple illustrative and nonlimiting example, and from studying the attached figures in which:

FIG. 3 is a view in longitudinal section of a watch fitted with a connecting link according to the invention;

FIG. 4 is a perspective view of a connecting link according to the invention;

DETAILED DESCRIPTION OF THE PREFERRED EMBODIMENTS

Figure 1:
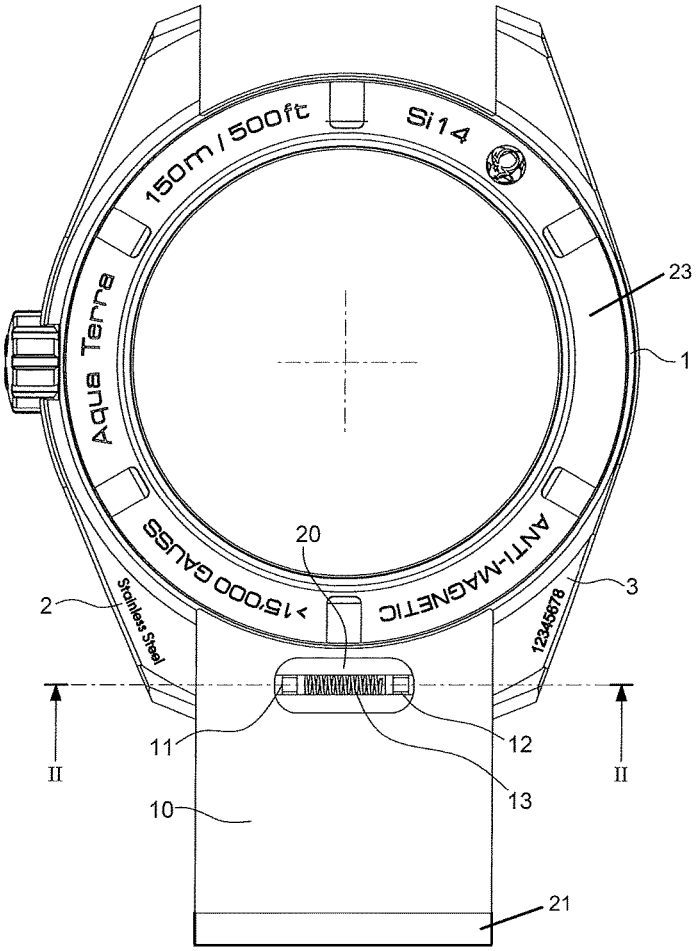
FIG. 1 is a view from underneath of a watch equipped with a connecting link according to the invention.

The invention relates to a fixing device for attaching a band 21 to a watch case 1 by means of a connecting link 10, the watch case 1 comprising a case middle 22, at least one pair of lugs 2, 3 and a case back 23, the connecting link 10 comprising a passage accommodating fixing means of attachment to the watch case 1.

According to the invention, the fixing means are incorporated into the connecting link and comprise a bar formed by elastic return means separating two pivots mounted with the ability to move inside the passage, along the longitudinal axis of the passage, and each capable of moving between a compressed position and a rest position in which the pivots are designed to rest in a housing formed in each lug of the case.

FIG. 1 depicts a connecting link 10 designed to connect a watch case 1 and a band. The connecting link 10 is of parallelepipedal overall shape and is designed to be housed without play between the lugs 2, 3 of the watch case 1. The connecting link 10 has two opposite lateral faces intended to be positioned against the lugs 2 and 3 of the case 1. The other two opposite lateral faces are, respectively, one placed against the case 1 and the other intended to be on the band side. The latter face comprises attachment means designed to accept a bar for connecting the connecting link 10 to a strand of the band. The lateral face resting against the watch case 1 is configured to conform to the shape of the case 1 and thus limit the clearance between the case 1 and the connecting link 10.

Advantageously, an opening is formed in the back of the connecting link 10 to provide access to the fixing means housed in a passage formed in the connecting link 10.

Advantageously, the opening 20 is situated in the middle of the connecting link 10, on the underside, so that it is not visible to the wearer. As illustrated, the opening 20 is oblong in shape but could very well adopt other shapes. It is possible for this opening 20 to be hidden by means of a rubber flap for example, and in this way no foreign bodies can become lodged in the housing 100 via the opening 20.

According to one particular embodiment of the invention, the connecting link 10 comprises a casing 30 equipped with elastic arms 32 acting as a replacement for the elastic return means. Such a casing 30 is fitted into the link 10 and has a drilling 34 passing heightwise through its middle for the passage of a screw 35 or any other fixing means. As can be seen, the casing 30 comprises two elastically deformable arms 32 positioned against the pivots 11, 12 and acting as springs. Advantageously, the casing 30 has a gap 31 making it easier for the elastic arms 32 to deform, and limit stops 33 for limiting the travel of the elastic arms and preventing these from deforming excessively.

The casing 30 may be made of any material that allows elastic deformation, such as certain plastics, certain composites, or even certain metals or alloys.

According to the invention, the fixing means are incorporated into the connecting link 10 and comprise a bar formed by elastic return means 13 separating two pivots 11, 12 mounted with the ability to move inside the passage, along the longitudinal axis of the passage, and capable each of moving between a compressed position and a rest position in which the pivots are designed to rest in a housing formed in each lug of the case.

The link 10 comprises two pivots mounted with the ability to move translationally in a housing, preferably of right cylindrical cross section, formed in the link. These pivots form the means of attachment and project at the lateral walls of the connecting link 10 so as to be able to collaborate with the holes 101, 102 formed in the lugs 2, 3 when the connecting link 10 is fixed on the watch case 1.

The pivots 11, 12 are mounted with the ability to move between a rest position in which they each collaborate with one of the holes 101, 102 of the lugs 2, 3 to hold the link 10 against the case 1, and a compressed position in which the connecting link 10 is free and the pivots 11, 12 are retracted inside the link 10.

Figure 2:
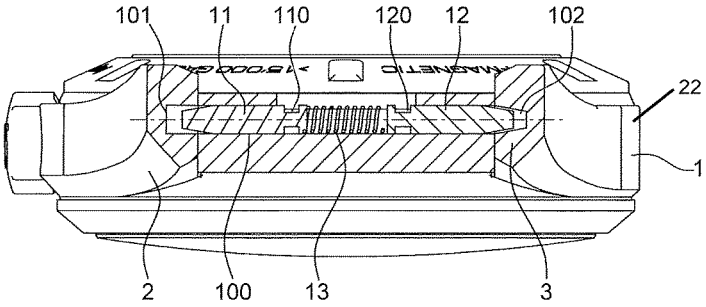
FIG. 2 illustrates a view in cross section on D-D of FIG. 1.
Figure 5:
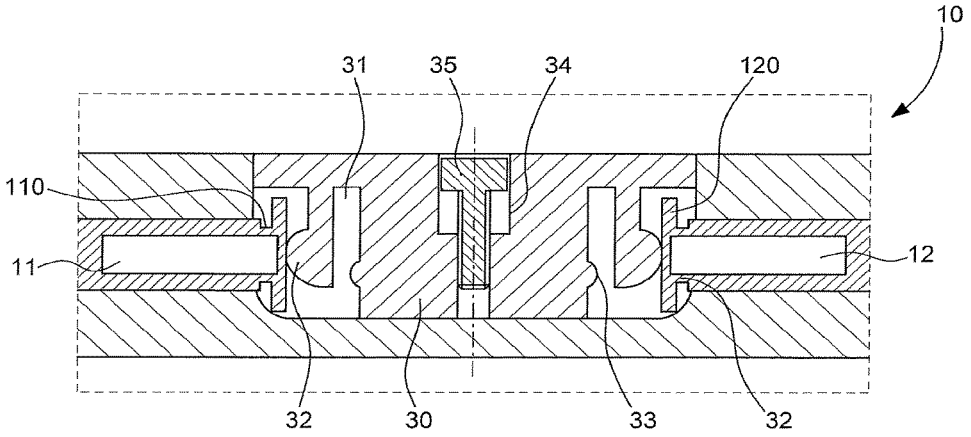
FIG. 5 is a view in section of a link according to the invention according to another embodiment.

Each pivot 11, 12 comprises a cylindrical body providing translational guidance in the housing formed inside the connecting link 10, as can be seen in FIG. 2. A spring 13 is positioned between the pivots, so as to apply a force that tends to keep the pivots in their rest position. Each pivot 11, 12 also comprises, at one of its ends, an engaging slot 110, 120, configured to collaborate with a tool, visible and accessible through the opening 20, so that by simultaneously applying pressure to each of the pivots these find themselves in the compressed position and no longer project. The other end of each of the pivots, referred to as the head, has a truncated cone shape or cylindrical shape designed to be housed in the holes in the lugs 2, 3 of the watch case 1. Thus, the heads of the pivots make it possible, according to the geometry of the holes, to produce a "tensioning" effect, namely to apply a return force to force the connecting link firmly against the case without clearance.

Obviously, the dimensions and shape of the pivots 11, 12 can vary, and the body may for example have a longer length so that it is better guided in the housing. A person skilled in the art will also be able to conceive of a hollow part in the body of the pivots 11, 12 to accept one end of the spring 13. Limit-stop means may also be provided in the housing to limit the travel of the pivots 11, 12 in the housing.

The pivots 11, 12 may be made of plastic, of ceramic, of composite materials or even of metal or metal alloy, including amorphous or partially amorphous metal alloys.

The holes 100, 101 machined in the lugs 2, 3 may have a right cylindrical cross section or alternatively a truncated cone shape cross section, as can be seen in FIG. 2. The holes may be machined perpendicularly in the lugs as illustrated in the figures or inclined at any angle that makes the machining of the holes in the lugs easier.

According to one particular advantageous aspect of the invention, the axis A of the holes 100, 101 of the lugs 2, 3 and the axis B of the bar are slightly offset, the axes A and B being parallel to one another and in the midplane of the connecting link, so as to offset the axis of the holes with respect to the axis of the housing formed in the link 10, this making it possible to force the connecting link 10 against the watch case as a result of the linear displacement of the pivots in the midplane of the connecting link, in a direction perpendicular to the housing accommodating the pivots, and to automatically eliminate the clearance between the connecting link 10 and the case 1.

It goes without saying that the present invention is not restricted to the embodiment that has just been described and that various modifications and simple variations can be conceived of by those skilled in the art without departing from the scope of the invention as defined by the claims attached to the present patent application. In particular, it will be appreciated that although it has been described in conjunction with a link of a band and a watch case that are made of a metallic material, the present invention may be applied in exactly the same way to links and cases made of some other hard material such as ceramic, a composite, or even plastic materials. The connecting link may also be a rigid insert overmoulded with plastic, with rubber, or covered with leather or with fabric.

What is claimed is:

1. A fixing device for attaching a band to a watch case by a connecting link, the watch case comprising a case middle, at least one pair of lugs and a case back, the connecting link comprising a passage accepting fixing means of attachment to the watch case, wherein the fixing means are incorporated into the connecting link and comprise elastic return means and two pivots mounted with the ability to move inside the passage, along a longitudinal axis of the passage, wherein the casing is positioned between the two pivots, wherein the casing includes two elastically deformable arms including a first arm positioned against an inner end of a first pivot of the two pivots and a second arm positioned against an inner end of a second pivot of the two pivots, and wherein each of the two pivots is capable of moving between a compressed position and a rest position in which an outer end of each of the two pivots is designed to rest in a hole formed in each lug of the watch case.

2. The fixing device according to claim 1, in which the holes in the lugs form a first axis, and the passage forms a second axis, and the first axis and the second axis are not coaxial.

3. The fixing device according to claim 1, in which the pivots comprise a cylindrical body and a truncated cone shape head, the said head being designed to collaborate with a hole in one of the lugs of the watch case.

4. The fixing device according to claim 1, in which the holes are of cylindrical or truncated cone shape.

5. The fixing device according to claim 1, in which the pivots comprise a cylindrical body and a head of cylindrical or truncated cone shape designed to collaborate with the holes.

6. The fixing device according to claim 1, in which the casing has a gap positioned on an opposite side of each of the elastic arms from the two pivots that makes it easier for the elastic arms to deform and limit stops for limiting the travel of the elastic arms.

7. The fixing device according to claim 1, in which the passage takes the form of a right cylinder.

8. The fixing device according to claim 1, in which the connecting link is made of plastic, of ceramic, of composite or of metal.

9. A watch comprising:

a case formed of a case middle having two pairs of lugs defining a connecting space for connecting with the case middle; and at least one connecting link accommodated in the connecting space, the connecting link comprising a passage accepting fixing means of attachment to the case, wherein the fixing means are incorporated into the connecting link and comprise elastic return means and two pivots mounted with the ability to move inside the passage, along a longitudinal axis of the passage, wherein the casing is positioned between the two pivots, wherein the casing includes two elastically deformable arms including a first arm positioned against an inner end of a first pivot of the two pivots and a second arm positioned against an inner end of a second pivot of the two pivots, and wherein each of the two pivots is capable of moving between a compressed position and a rest position in which an outer end of each of the two pivots is designed to rest in a hole formed in each lug of the watch case.

10. The watch according to claim 9, in which each of the elastic arms includes one end fixed to the casing and a free end opposite to the fixed end.

11. The fixing device according to claim 1, in which each of the elastic arms includes one end fixed to the casing and a free end opposite to the fixed end.

* * * * *